US006641432B1

(12) United States Patent
Ouyoung

(10) Patent No.: US 6,641,432 B1
(45) Date of Patent: Nov. 4, 2003

(54) WATERPROOF CELL CABINET

(75) Inventor: Scott Ouyoung, Taichung Export Processing Zone (TW)

(73) Assignee: Globe Union Industrial Corp., Taichung Export Processing Zone (TW)

( * ) Notice: Subject to any disclaimer, the term of this patent is extended or adjusted under 35 U.S.C. 154(b) by 0 days.

(21) Appl. No.: 10/270,636

(22) Filed: Oct. 16, 2002

(51) Int. Cl.[7] ..... H01R 3/00
(52) U.S. Cl. ..... 439/500; 429/99
(58) Field of Search ..... 429/96, 97, 98, 429/99, 100; 439/500

(56) References Cited

U.S. PATENT DOCUMENTS 5,537,022 A * 7/1996 Huang ..... 320/107
5,598,082 A * 1/1997 Gilpin et al. ..... 200/293.1
6,071,639 A * 6/2000 Bryant et al. ..... 429/97
6,293,428 B1 * 9/2001 Chen ..... 222/55
6,512,348 B1 * 1/2003 Wellisz et al. ..... 320/107
6,551,739 B1 * 4/2003 Chen ..... 429/99

* cited by examiner

*Primary Examiner*—Lynn Feild
*Assistant Examiner*—Thanh-Tam Le
(74) *Attorney, Agent, or Firm*—Leong C. Lei

(57) ABSTRACT

A waterproof cell cabinet comprised of a hollow casing, a cell holder, a connection disk, a lid and a pair of locking plates; the casing being adapted with a coupling flange and two positioning channels on the inner circumference of the coupling flange and containing a retaining plate with resilient member and the cell holder in the casing, multiple rooms in the center of the casing with each provided with an induction coil; the connection disk being adapted to the front of the cell holder and integrated with two fixtures sandwiching a dovetail one end, and two retaining plates on both sides of the other end; the lid having on its one end provided with a dish and a rib at the center of the dish; two wings being provided on the outer circumference of the lid and a locking button extending from the other end of the lid to lock into the dovetail; two semi-circular locking plates each containing a semi-circular channel being provided between the connection disk and the lid; two fixation blocks being provided on the inner circumference of the locking plate to lock into a locking hole; and the lid being fully secured in the coupling flange to provide an enclosed space.

1 Claim, 4 Drawing Sheets

WATERPROOF CELL CABINET

BACKGROUND OF THE INVENTION 1. (a) Field of the Invention

The present invention is related to a waterproof cell cabinet, and more particularly, to one that keeps off ingression of humidity and water while securing the cell holder inside the cabinet.

2. (b) Description of the Prior Art

Whereas any mechanism or device requires its source of power, electric power usually is used as the source. Electric power is available in wire and wireless types and both are found with their own pros and cons. The present invention is an improvement exclusively for the wireless power device. The prior art of wireless power supply device is usually provided with a cell holder to place a cell or multiple cells to provide the power needed by the device. However, no protection means has been provided to the prior art of the cell holder and the following flaws are experienced in the use of the prior art:

1. Induction coil under long term use is vulnerable to get rusty due to the humidity in the air thus fails to provide the power as designed, and furthermore to render the mechanism or device inoperative; for example, a soap dispenser for being usually installed in a place present with high humidity and water contact such as in a bathroom or kitchen; and the exposed cell can easily have direct contact with water or liquid resulting in hazards of fire or electric shock due to circuit shortage; and
2. Once the mechanism or the device containing the cell holder is in operation, the cell holder often subject to the vibration or swing and falls out of its place resulting in power interruption, and failure of the mechanism or the device.

SUMMARY OF THE INVENTION

The primary purpose of the present invention is to provide a cell cabinet that provides a fully enclosed space to seal in the cell, thus to keep off ingression of humidity and water.

Another purpose of the present invention is to provide a cell cabinet that contains and secures a cell holder disregarding how violently a unit the cell cabinet attached to it is shaken or swung.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
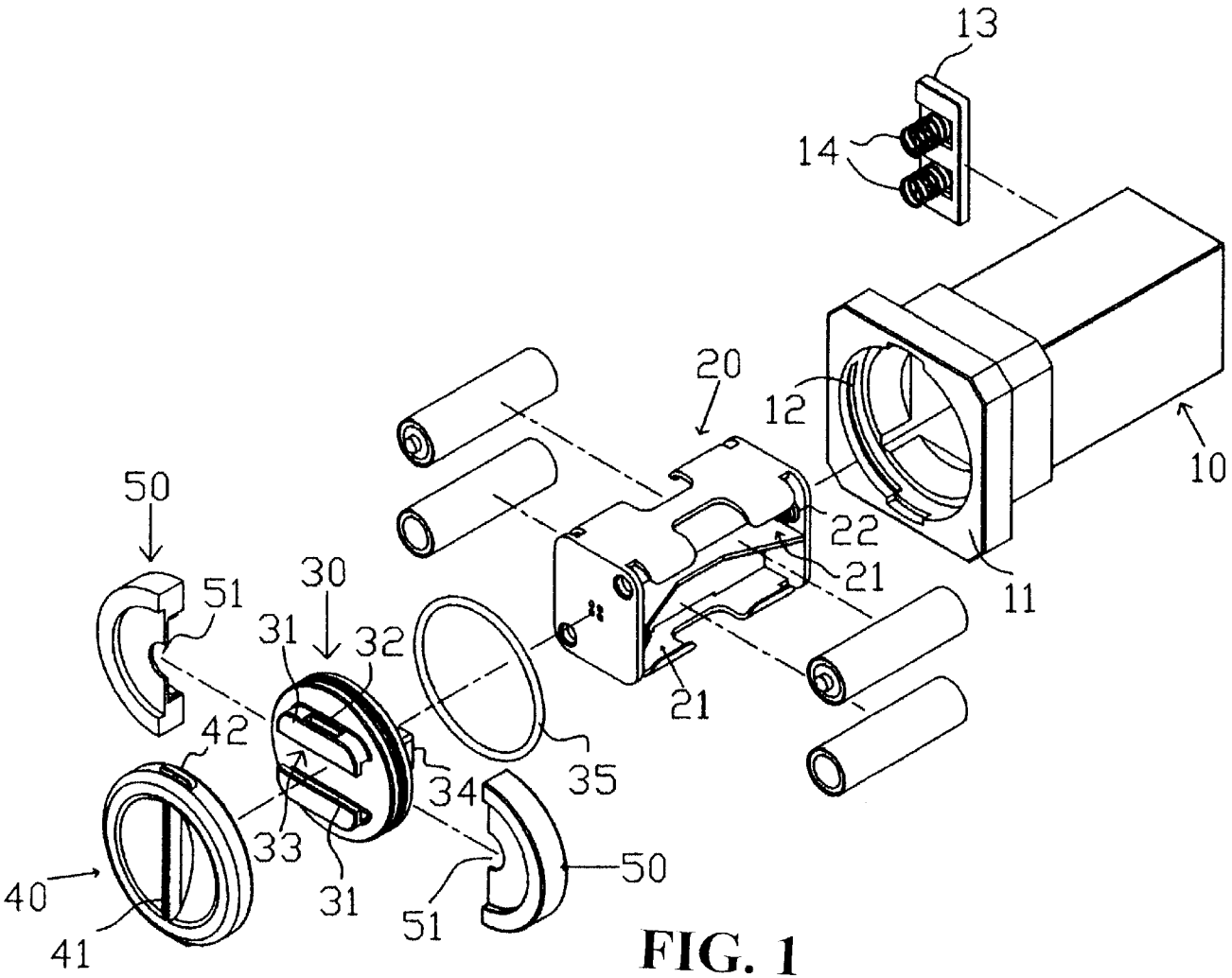
FIG. 1 is an exploded view of a preferred embodiment of the present invention.
Figure 2:
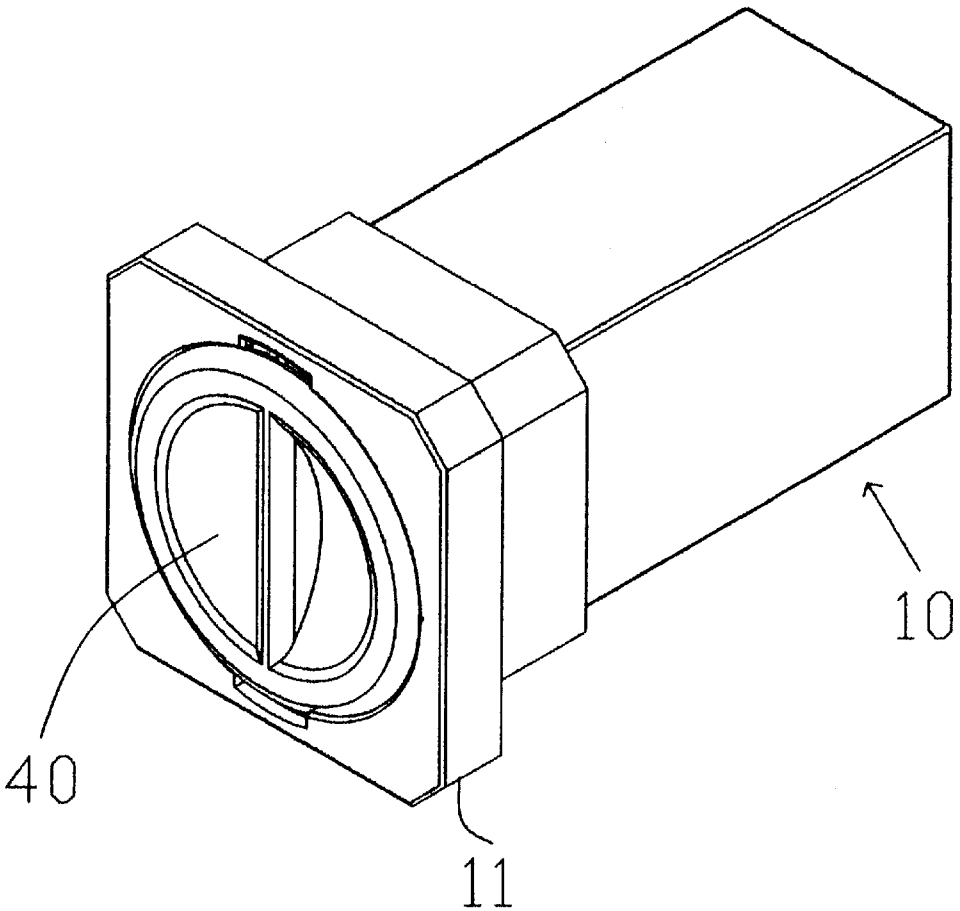
FIG. 2 is a view of the preferred embodiment of the present invention as assembled.
Figure 3:
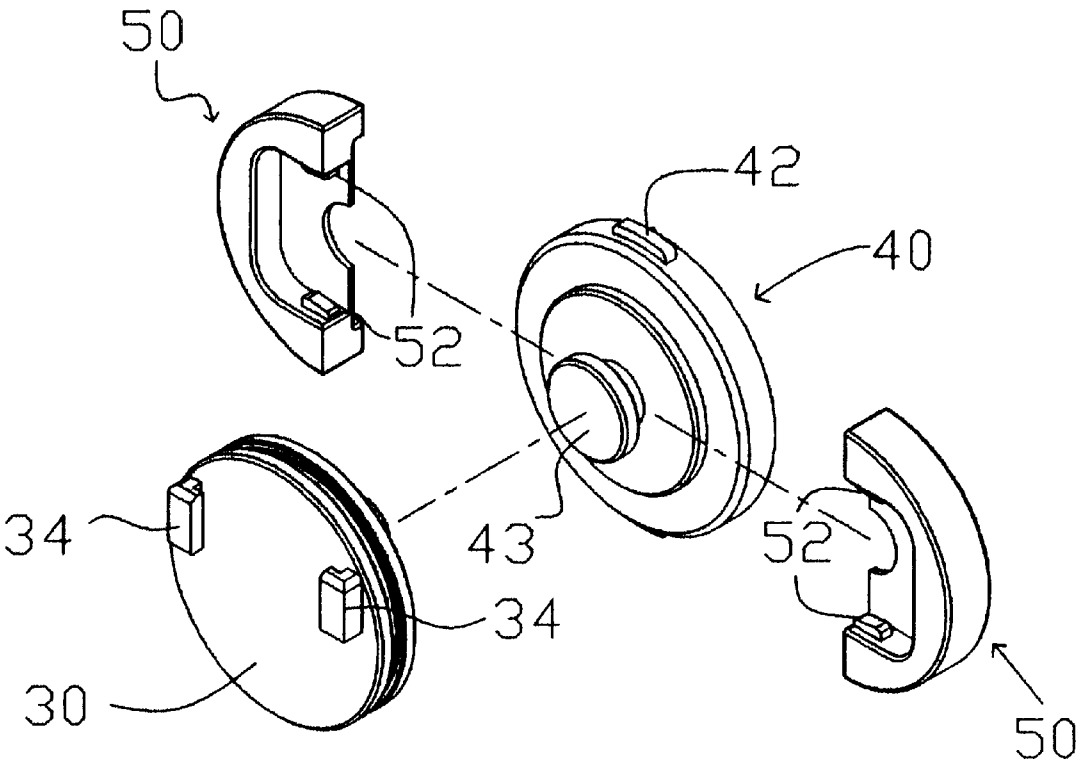
FIG. 3 is an exploded view showing a lid and a connection disk of the preferred embodiment of the present invention.
Figure 4:
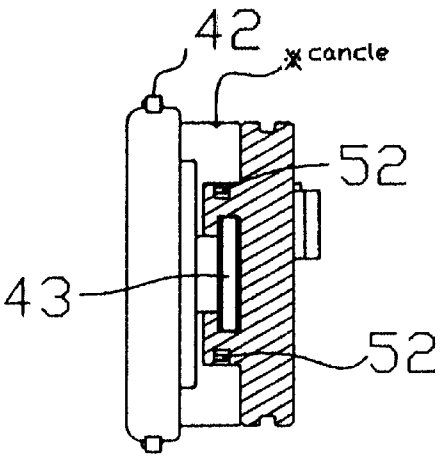
FIG. 4 is a sectional view showing the lid incorporated to the connection disk of the preferred embodiment of the present invention.
Figure 5:
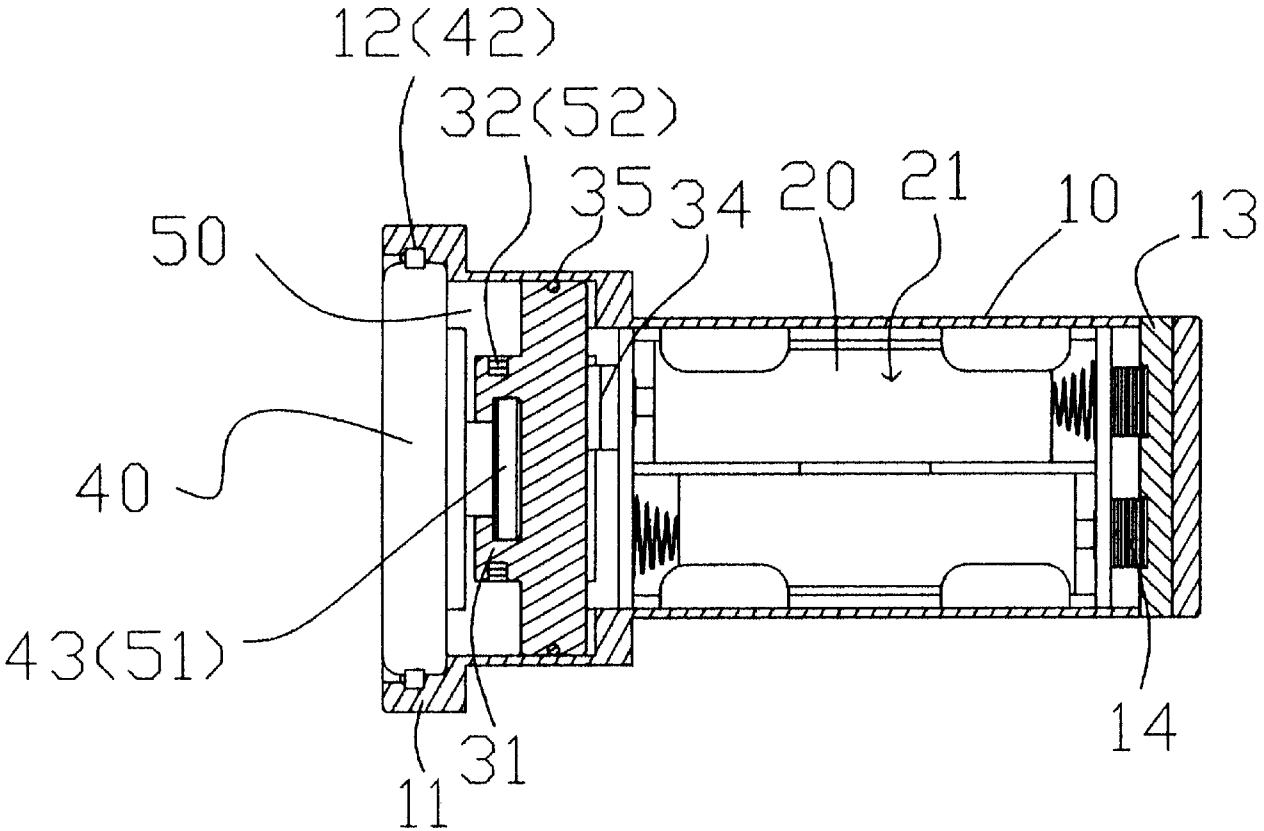
FIG. 5 is a sectional view of the preferred embodiment of the present invention.

Referring to FIGS. 1 through 5, a preferred embodiment of the present invention is essentially comprised of a hollow casing 10, a cell holder 20, a connection disk 30, a lid 40 and two locking plates 50. Wherein, a coupling flange 11 extends from the front of the casing 10 and two positioning channels 12 opposite to each other are provided in the circumference of the coupling flange 11 at where close to the end of the casing 10. The casing 10 contains a retaining plate 13. Two resilient members 14 are fixed on the end of the retaining plate 13. The cell holder 20 related to a rectangular pillar contains multiple accommodation rooms 21 with each accommodation room 21 provided at its internal end an induction coil 22. The connection disk 30 has two fixtures 31 extending from the center of one end of the connection disk 30.

A locking hole 32 is provided on a side edge of each fixture 31 and a dovetail 33 is provided at where between both of the fixtures 31. Two retainers 34 are provided on the other end of the connection disk 30. A washer 35 is fixed to the outer circumference of the connection disk 30. The lid 40 made in disk shape has at its one end indicating a dish shape and a rib 41 is provided at the center of the dish and two wings 42 opposite to each other are extended from the circumference of the lid 40. On the other end of the lid 40 is extended a locking button 43. Each of those two locking plates 50 is in semi-circular shape and has provided at the center of its tangent plane a semi-circular channel 51. Two fixation blocks 52 opposite to each other are provided on the inner side of the circumference of one end of the locking plate 50.

The cell holder 20, the connection disk 30 and the lid 40 are placed in sequence inside the casing 10 with the cell holder 20 to be merely inserted in the casing 10. The cell holder 20 is respectively compressed and held by the retainers 34 of the connection disk 30 and the resilient members 14 of the returning plate 13 so to secure the cell holder 20 in the casing 10. The locking button 43 from the lid 40 is locked into the dovetail 33 to incorporate the lid and the connection disk 30 in one with both locking blocks 52 from the locking plate 50 to merely lock into their respectively locking holes 32. The lid is fully locked in the coupling flange 11 of the casing to provide a fully enclosed space inside the casing 10. When adapted to any facilities operating in bathroom, kitchen or any other place present with high humidity and water contact, e.g. a soap dispenser, the present invention is capable of preventing the ingression of humidity and water into the cell holder so to slow down the process of developing rust and extend service life of a cell in the cell cabinet of the present invention. Furthermore, the covering design of taking advantage of the space to inhibit vibration for the cell to be firmly secured in the cabinet.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A waterproof cell cabinet is essentially comprised of a hollow casing, a cell holder, a connection disk, a lid and two locking plates; wherein, the casing in rectangular; having extended from its front a coupling flange; two positioning channels opposite to each other being provided in the circumference of the coupling flange at where close to the end of the casing; and the casing containing a retaining plate and two resilient members fixed on the end of the retaining plate; the cell holder, related to a rectangular pillar containing multiple accommodation rooms; and an induction coil being provided at the internal end of each accommodation room; the connection disk having two fixtures extending from the center of one end of the connection disk; a locking hole being provided on a side edge of each fixture; a dovetail being provided at where between both of the fixtures; two retainers being provided on the other end of the connection disk; a washer being fixed to the outer circumference of the connection disk, the lid in disk shape having at its one end a dish; a rib being provided at the center of the dish; two wings opposite to each other extending from the circumference of the lid; and a locking button extending from the other end of the lid; and each of said two locking plates being made in semi-circular shape; a semi-circular channel being provided at the center of the tangent plane of each of said two locking plates; and two fixation blocks opposite to each other being provided on the inner side of the circumference of one end of the locking plate; characterized by that: the cell holder, the connection disk and the lid being placed in sequence inside the casing; the cell holder being inserted in the casing; the cell holder being compressed and held by the retainers of the connection disk and the resilient members of the retaining plate; the cell holder being secured in the casing; the locking button from the lid being locked into the dovetail to incorporate the lid and the connection disk in one; both locking blocks from the locking plate being locked into locking holes; the lid being fully locked in the coupling flange of the casing to provide a fully enclosed space inside the casing.

* * * * *